United States Patent [19]

Gassaway

[11] Patent Number: 4,858,878

[45] Date of Patent: Aug. 22, 1989

[54] MOUNT FOR SECURING PROTECTED ARTICLES

[76] Inventor: Mark M. Gassaway, 2201 Stern La., Oxnard, Calif. 93035

[21] Appl. No.: 111,459

[22] Filed: Oct. 21, 1987

[51] Int. Cl.[4] ..... A47F 5/00

[52] U.S. Cl. ..... 248/551; 248/680; 248/316.1; 248/507; 312/265; 70/58

[58] Field of Search ..... 248/551, 552, 553, 637, 248/672, 674, 675, 678, 680, 681, 309.1, 316.1, 500, 505, 507; 211/4; 312/265, 264, 257 R; 70/62, 58, 57; 224/270, 315; 206/576, 320

[56] References Cited

U.S. PATENT DOCUMENTS

| | | | |
|---|---|---|---|
| 292,066 | 1/1884 | Smith | 312/265 |
| 926,230 | 6/1909 | Avery | 312/265 |
| 1,828,088 | 10/1931 | Robinson | 312/265 |
| 2,402,682 | 6/1946 | Shriro | 248/505 |
| 3,180,473 | 4/1965 | Garvey | 70/57 |
| 3,356,429 | 12/1967 | Davis | 248/222.4 |
| 3,850,392 | 11/1974 | Gassaway . | |
| 4,268,099 | 5/1981 | Clausen | 248/551 |
| 4,289,242 | 9/1981 | Kenyon | 211/4 |
| 4,535,863 | 8/1985 | Becker | 248/551 |
| 4,634,009 | 1/1987 | Gassaway . | |

FOREIGN PATENT DOCUMENTS

| | | | |
|---|---|---|---|
| 1094961 | 12/1960 | Fed. Rep. of Germany | 312/265 |

*Primary Examiner*—Alvin C. Chin-Shue
*Assistant Examiner*—Robert A. Olson
*Attorney, Agent, or Firm*—Donald D. Mon

[57] ABSTRACT

A device for the securing of protected articles such as computers to the side or a top of a desk, which includes a base plate having an adhesive pad secured between the base plate and the desk or other object. A plurality of posts rise from the base and are engaged by a second plate. The protected article is placed in the spacing between the plates and between the posts. Releasable locking means holds this engagement of the second plate to the posts. A retention bracket is restrained to the assembled plates and posts and includes a pair of shoulders overhanging the spacing between the plates to prevent removal of the article from the spacing.

8 Claims, 4 Drawing Sheets

MOUNT FOR SECURING PROTECTED ARTICLES

FIELD OF THE INVENTION

This invention relates to the securing of protected articles to a vertical substrate, for example, a computer to the side or top of a desk.

BACKGROUND OF THE INVENTION

The art of securing articles to be protected ("protected articles") to a substrate body has been an active one, especially since the advent of relatively costly, relatively small products such as computers and calculators. Well-known systems for such a function are shown in Gassaway patents U.S. Pat. Nos. 3,850,392 and 4,634,009. This system is characterized by a base plate held to a substrate body, usually by means of an adhesive pad. Then the protected article is mounted directly or by means of a second plate to which it is fastened (U.S. Pat. No. 3,850,392), or is trapped in surrounding structure which in turn is attached to the base plate (U.S. Pat. No. 4,634,009).

The existing systems, and others, function well on relatively rigid horizontal substrates. However, many newer computers are too large to be placed on a desk top, and are unsuited to be placed on the floor. The proper place to mount them is on a side wall which is vertical. A problem with many or even most of these substrate bodies is that they are often relatively thin and flexible, because they were not designed as load-supporting structures. Instead they were provided primarily for appearance or modesty. Still they do have adequate strength to support the protected article, and it becomes the problem of the security mount to conform to the other limitations of the substrate body while performing its own function of protection.

At the same time, the absolute and relative cost of the protected article must be compared to the cost of a security mount to protect it. Obviously a security mount that costs as much as the protected article is rarely economically justifiable.

Also, absolute invulnerability cannot as a practical matter be provided. Given sufficient time, patience, and tools, practically any mounting means can be overcome. The thief's problems are a shortage of time, and the desire not be be encumbered excessively by tools and equipment. A crowbar is his primary tool and about five minutes is his effective time span. The objective of a successful security mount is suitably to delay a thief, to require inconvenient tools, or to cause him to damage the protected article so it cannot be fenced. Any of the these will frustrate a practical thief.

An interesting situation arises in the mounting and protection of articles such as are contemplated to be protected by this invention. Merely to hold the article reliably to a substrate body does not require much strength. Often these articles will weigh less than 50 pounds, for example. A few screws or bolts will generously attend to the structural requirement. However, a thief with skillful use of a crowbar, can readily exert hundreds of pounds of localized force, but not for long. A successful mount will have to resist these "spike" forces.

Further with regard to the usual substrate material, such as a metal desk side, these tend to be somewhat flexible, and are liable to vibrate noisily, and also to deform wavily, or as an oil-can when a running device is attached to it. A suitable security mount must not contribute to the noise, and should assist in stabilizing the substrate.

It is an object of this invention to provide a security mount that reliably supports a protected article on a vertical surface, and secures it against ready removal by unauthorized means. Also, it is easily installed, the protected article can readily be installed and removed, and the mount is adaptable to receive articles of widely differing dimensions.

It is another object of this invention to extend the usefulness of the system shown in Gassaway patent U.S. Pat. No. 4,634,009, by providing all of the retention features on the mount itself, without requiring the attachment of anything to the protected article for retention.

It is another object of this invention to extend the effectiveness of the system shown in Gassaway patent U.S. Pat. No. 4,634,009 where used on furniture of lesser quality, for example on veneered furniture which can readily, easily be delaminated.

BRIEF DESCRIPTION OF THE INVENTION

A security mount according to this invention has a base plate, and an adhesive pad adhered to the base plate and adherent to a substrate body.

A plurality of posts rise from the base plate and are engaged by a second plate. A protected article is placed in the spacing between the plates and between the pairs of posts. Releasable locking means holds this engagement of the second plate to the posts. A plurality of retention brackets are connected to this structure, having flanges to overhang the protected body so as to secure the article against in-plane removal from between the plates. In the preferred embodiment the bracket also shields two sides of the protected article to prevent its contents such as circuit boards from being stripped from these sides.

On vertical walls and on certain substrates, bolt means will be passed through the base plate and through the substrate body, additionally to hold the base plate to the body.

As an option to the use of a bolt penetrating the desk, a headed clip may be adhered to the substrate body and engaged in a key hole slot in the base plate, as will be described below.

The above and other features of this invention will be fully understood from the following detailed description and the accompanying drawings, in which:

DETAILED DESCRIPTION OF THE INVENTION

Figure 1:
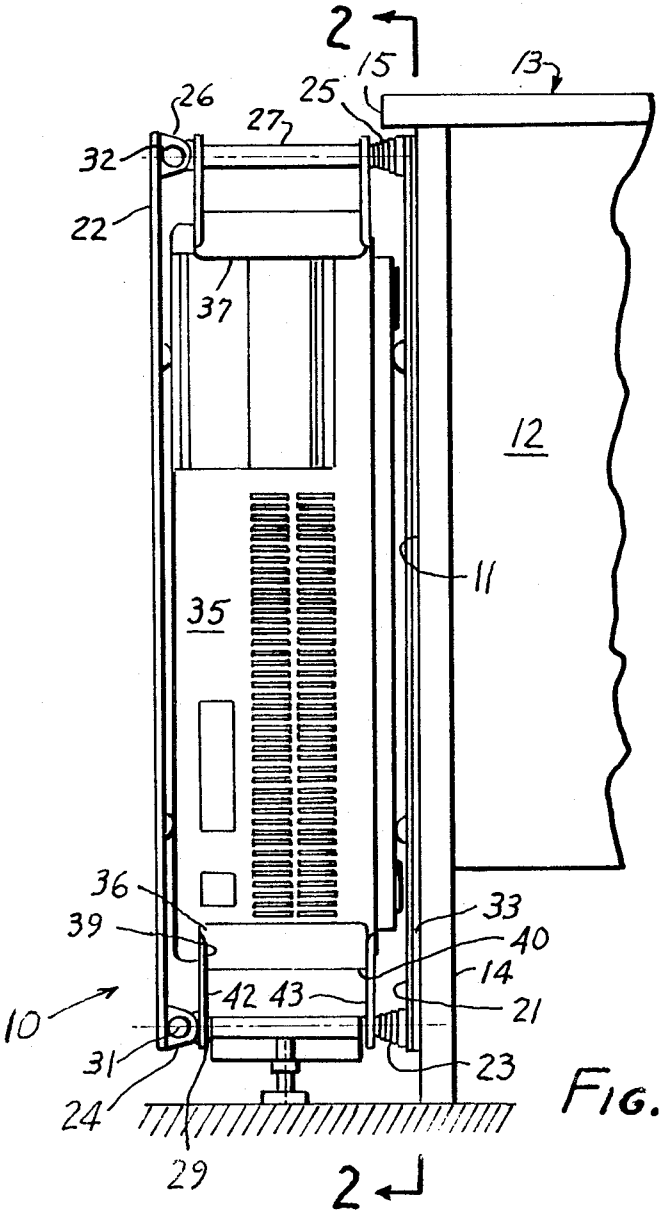
FIG. 1 is a front view of a security mount according to this invention, installed and mounting-protected article.
Figure 3:
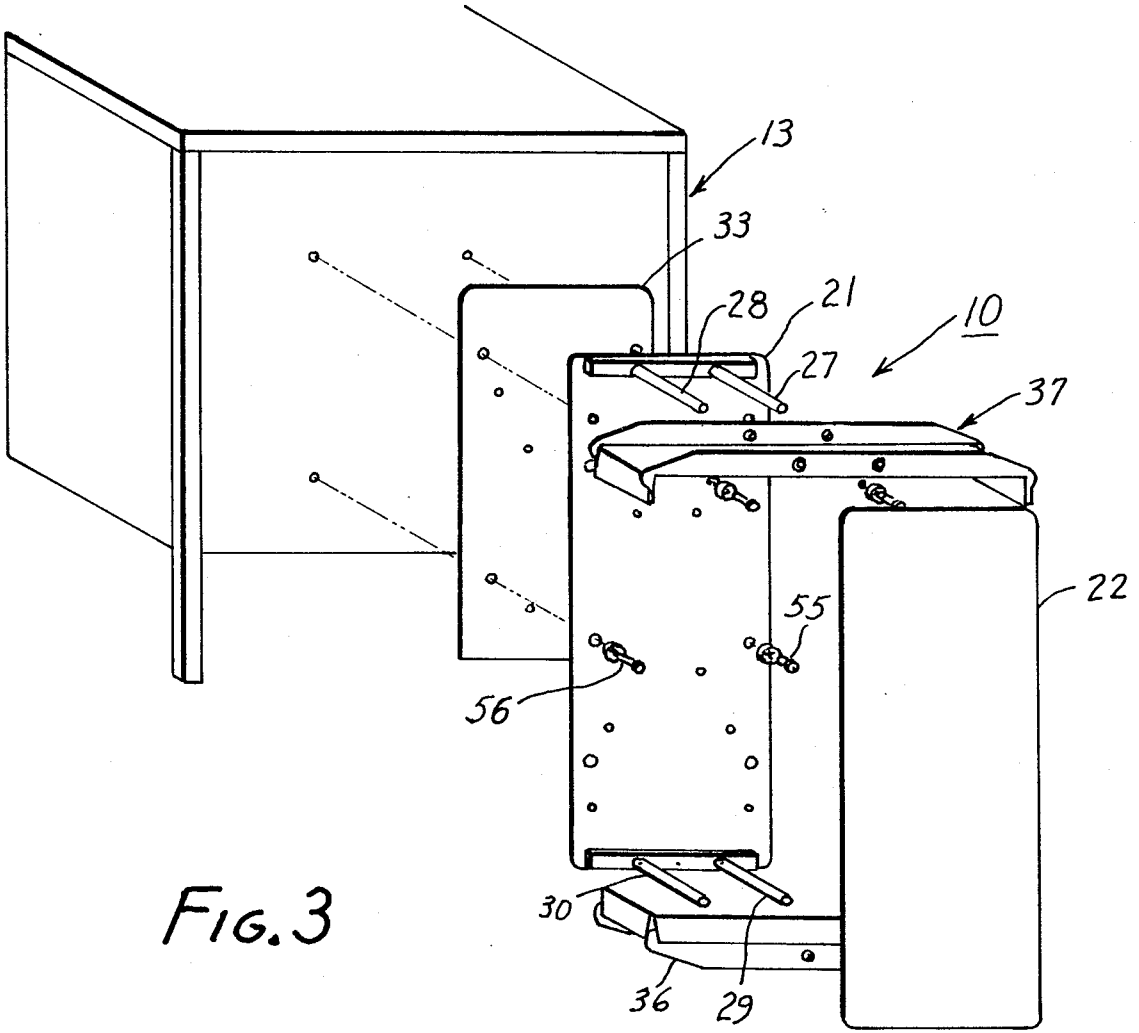
FIG. 3 is an exploded view of FIG. 1.
Figure 4:
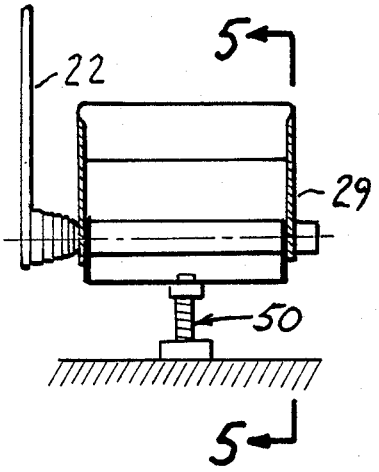
FIG. 4 is an enlarged portion of FIG. 1.
Figure 5:
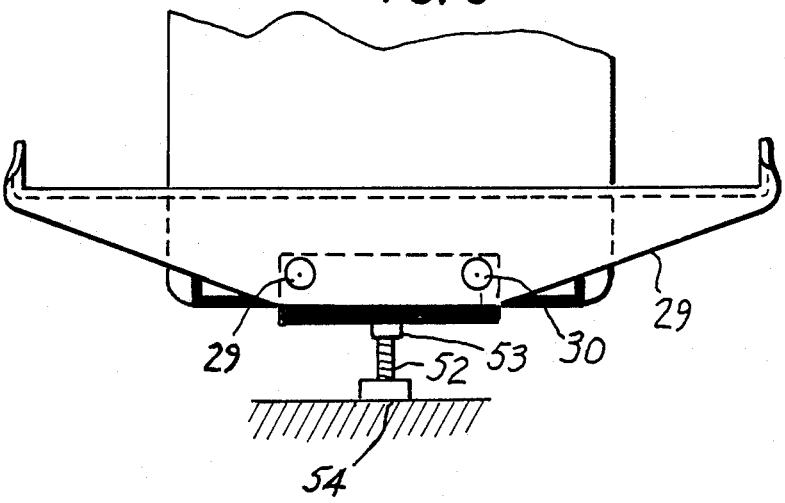
FIG. 5 is a fragmentary cross-section taken at line 5—5 in FIG. 4.

The presently-preferred embodiment of a security mount 10 according to the invention is shown in FIG. 1, fixed to the side wall 11 of a substrate body 12, in this case a desk 13, whose legs 14 and overhang 15 are shown.

The security mount includes a metal base plate 21, a second plate 22, four anchor blocks 23, 24, 25, 26, four posts 27, 28, 29, 30, and a pair of releasable lock structures 31 and 32. An adhesive pad 33 substantially covers one surface of base plate 21. It is adhered to the base plate, and is adherent to a substrate body. In FIG. 1, it is shown adhered to side wall 11, thereby mounting the base plate to the body.

Full details of all of the above-described elements of the security mount are shown in Gassaway patent U.S. Pat. No. 4,634,009, which patent is incorporated herein by reference in its entirety for its showing of these elements and of their construction and operation.

In this invention, there is a spacing between the two plates to receive a protected article 35. As illustrated herein, article 35 is restrained against in-plane removal by a pair of brackets 36, 37. Both brackets are identical, so that only bracket 36 will be described in detail.

As shown, it forms a cradle 38 with two bounding shoulders, (sometimes called arms) 39, 40 and a base 41. The base 41 centers the article, and shoulders 39 and 40 prevent its lateral movement. Two mounting flanges 42, 43 are apertured to pass a pair of the posts. They act as a spacer between the two plates. One bracket is at the top, and the other is at the bottom. With these brackets installed, the protected article is trapped against movement in all in-plane directions. The base of this bracket protects its respective side of the protected article. Then parts such as circuit boards cannot be stripped from the article at these vulnerable places while the article is in the mount.

An optional foot 50 may be placed beneath the lower bracket. It is best provided as a U-shaped metal channel 51 spindled on the two lower posts between the flanges on the lower bracket. A screw 52 is threaded into the base of the channel, with a lock nut 53 and a foot pad 54 on it. The foot can thereby readily be adjusted to support the installed mount.

Figure 6:
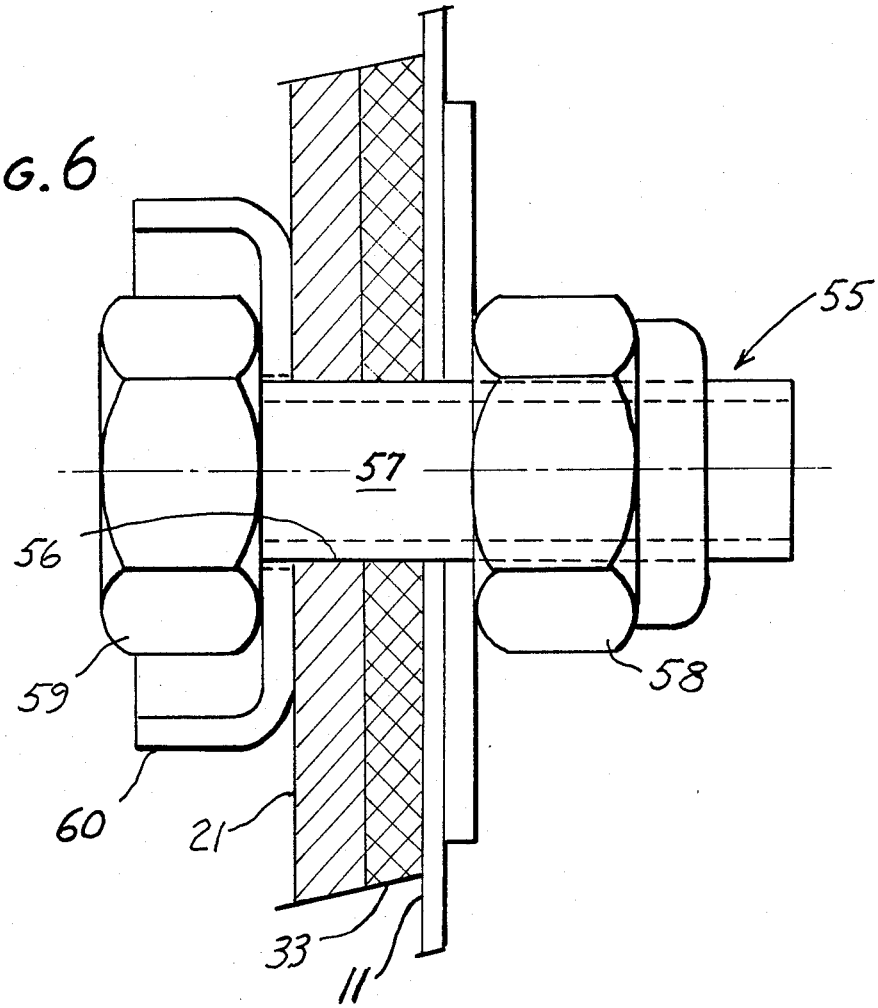
FIG. 6 is a fragmentary section of a bolt fastening.

When the mount is used on a vertical wall or on furniture of lesser quality, a plurality of bolts 55, usually four in number, will be passed through openings 56 in the base plate as shown in FIG. 6. The shank 57 of the bolt passes also through the adhesive pad and the substrate body. Its thread receives a nut 58. Its head 59 is fitted in a cup-like washer 60 that prevents side access to the the driving surfaces, thereby protecting the bolt from removal.

Figure 7:
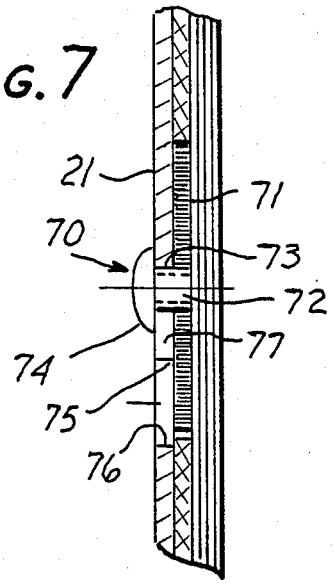
FIG. 7 shows an alternate fastening means.
Figure 8:
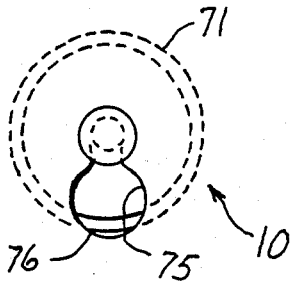
FIG. 8 is a side view taken at line 8—8 in FIG. 7.

In some instances it is objectionable, or may be impractical, to drill into the substrate body or to have access to the backside of the wall. As a substitute there is shown in FIGS. 7 and 8 an adapter clip 70 with a plate 71, preferably made of rubber which can be cemented to the side wall. A clip 72 includes a post 73 and an enlarged circular head 74. If desired, a metal insert can be cast into the rubber plate, and the post threaded into it. Interestingly, because the foam adhesive pad surrounds these plates, they would frustrate the flow of cement dissolvers to the plates, thereby protecting them from chemical removal.

The base plate is provided with a key hole slot 75 with a port 76 that will pass the head, and a neck 77 that will not. At the time the base plate is installed, the adapter clip or clips will have already been applied to the substrate. The plate will be put over the heads and slid down to the position shown in FIGS. 7 and 8, and then the adhesive pad will be pressed in place. The adapter will perform the same service as the bolts.

The installation of the device will be understood from the Gassaway patent and from the foregoing. Briefly stated, in the device of FIG. 1, the base plate will first be adhered to the substrate by the adhesive, and the bolts installed, when they are used. Then the posts are attached to the base plate (if they are not already on the base plate). The article can be placed against the base plate between the posts, and the brackets put on the posts. Then the second plate is fixed and locked to the four posts. The protected article is now fully trapped. Bumpers 80 can optionally be placed between the article and the plates.

If preferred, the brackets can first be put on the posts, and the article passed between the brackets before the second plate is applied.

If the foot is used, it will have been spindled onto the posts along with the bottom bracket, and the foot will be adjusted after the device is installed.

The bolts or adapters provide a strong retention of the mount and the protected article to the substrate body. However, a strong lift with a crowbar could in some cases strip them and release the mount. The bolts provide good support in shear, and positive retention, but in some installations, such as on thin metal desk walls, their capacity is limited as to resisting peak forces. Also, even with felt or other damping material between the base plate and the substrate, there is considerable flexibility of substrate permitted by them. This permits noisy vibration, and enables access of tools by flexure of the substrate.

The adhesive pad overcomes these problems. It causes the substrate and the base plate to function as a pair, damping vibrations and reducing the flexibility of the substrate. Even more importantly, the pad provides a strong secondary resistance to popping-off of the base plate. It has a strong retentive force over a large area which cannot be overcome by a strong lift. This frustrates a crowbar lift.

Peeling off of the adhesive pad is resisted by the bending strength of the base plate.

For installations on furniture likely to be delaminated, the bolts transfer some of the load to the reverse side of the substrate body and make this much more difficult.

This invention is useful on both horizontal and vertical bodies, and when it includes fastening means holding the base plate to the body, it is especially suited for use on vertical bodies.

Figure 2:
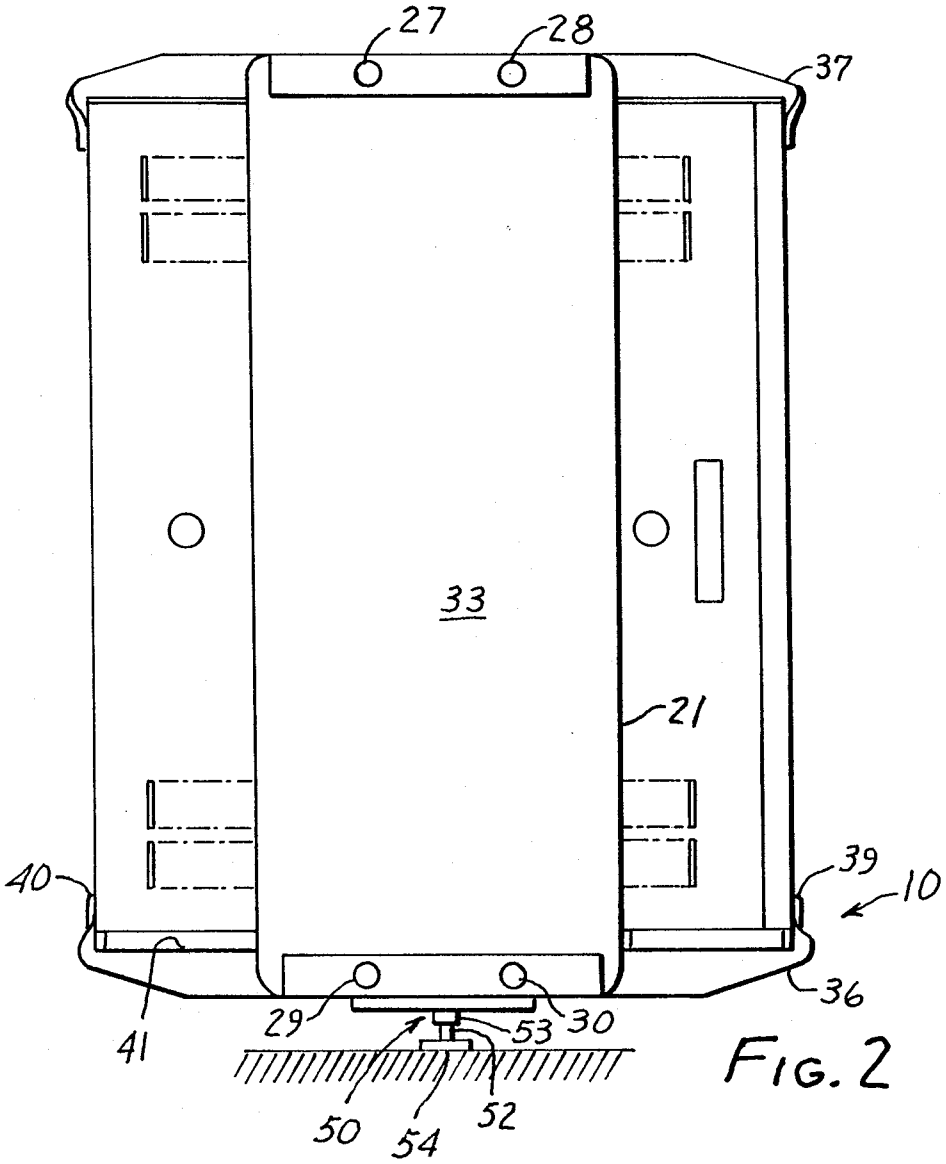
FIG. 2 is a side view taken at line 2—2 in FIG. 1.

The bracket shown in FIGS. 1 and 2 is a convenient means to prevent in-plane movement of the protected article. It is an improvement over the construction shown in Gassaway U.S. Pat. No. 4,634,009. In this Gassaway patent, the protected article itself is provided with retention means that cooperate with the mount to prevent in-plane removal, the illustrated bracket has overhanging flanges to perform this function, so that nothing has to be done to the protected article.

Figure 10:
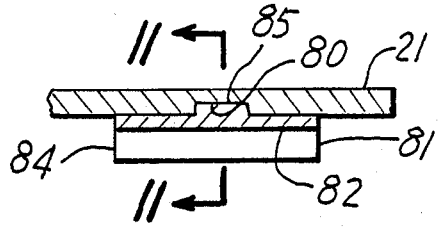
FIG. 10 is a fragmentary view of another bracket.
Figure 11:
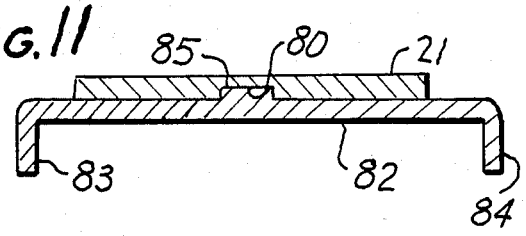
FIG. 11 is a cross-section taken at line 11—11 in FIG. 10.
Figure 9:
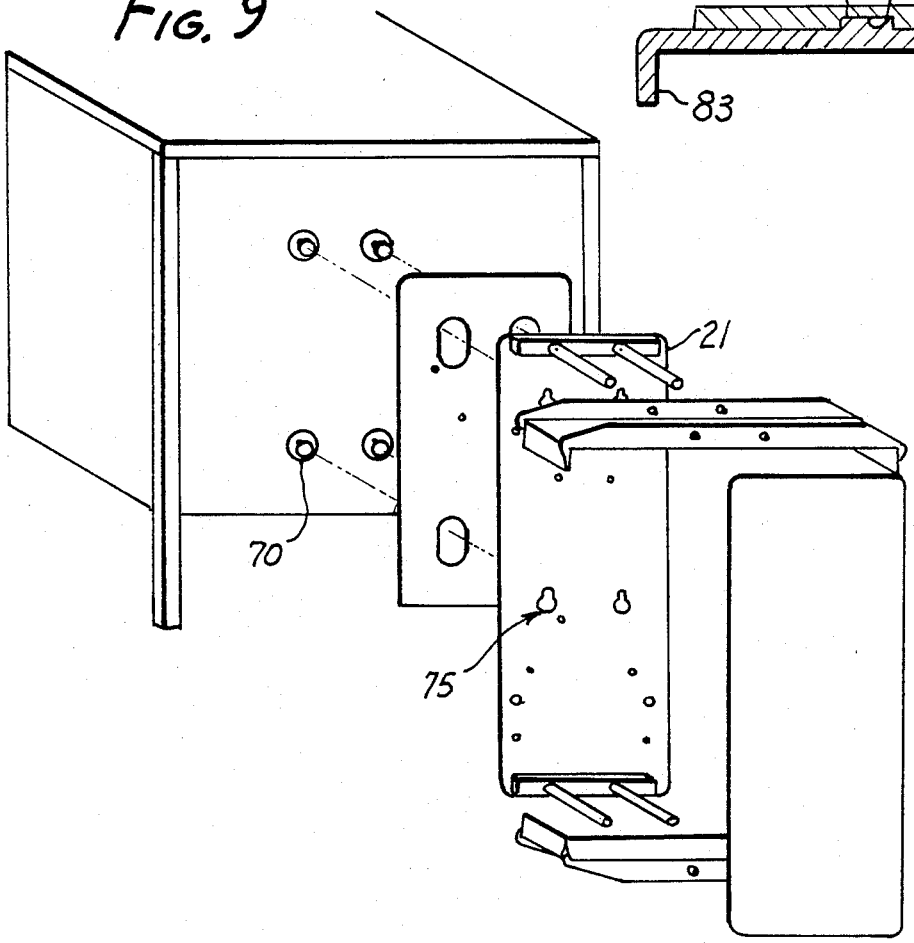
FIG. 9 is an exploded view of an assembly using the fastening means of FIG. 7.

FIGS. 10 and 11 show another suitable bracket. A socket 80 is formed in the bottom of the second plate. A U-shaped bracket 81 with a central bight 82, two flanges 83, 84 and a stud 85 is placed between the second plate and the protected article. The post projects into the socket. Then the flanges restrain the protected article. Sideward movement is prevented by the posts should no bracket be provided there.

This invention provides a highly reliable security mount useful on vertical or horizontal bodies. It can provide secondary protection against peak forces and against furniture delamination, and can accept protected articles without modification of the articles to provide for their retention.

This invention is not to be limited to the embodiments shown in the drawings and described in the description, which are given by way of example and not of limitation, but only in accordance with the scope of the appended claims.

I claim:

1. A security mounting for releasably holding a protected article to a substrate body, comprising:

a base plate and a second plate, each having a substantial planar area;

a plurality of posts connected to said plates holding said plates parallel to and spaced from one another with a spacing between them to receive the protected article;

lock means releasably holding one of said plates to said posts;

an adhesive pad having a substantial area adhered to said base plate and being adherent to said substrate body; and a rigid saddle-like bracket restrained to the connected plates and posts, said bracket having a pair of arms partially overhanging the spacing between the plates to prevent in-plane removal of a protected article from the said spacing past the arms.

2. A security mounting according to claim 1 which includes a pair of said brackets each having a pair of flanges with a pair of apertures passing through said flanges to receive the posts thereby to restrain the bracket to the connected posts and plates.

3. A security mount according to claim 1 in whcih said bracket includes restraint means for restraining the bracket to the connected posts and plates, said restraint means comprising a stud and a socket, one on the second plate and the other on the bracket.

4. A security mounting according to claim 1 in which said base plate is apertured to pass fastening means attachable also to said substrate body.

5. A security mounting according to claim 4 in which said fastening means comprises a headed bolt passed through said plate with its head on the side of the plate facing the second plate, and a nut on the opposite side of the body.

6. A security mounting according to claim 4 in which said fastening means comprises a plate adherable to said substrate body, a post extending from said last named plate, and an enlarged disc on said post, said base plate having a keyhole slot respective to said fastening means enabling the disc to pass through the slot, after which the base plate is shifted to move the slot to trap the fastening means.

7. A security mounting according to claim 1 in which a foot member is placed adjacent to a pair of said posts adapted to space the posts from an adjacent surface.

8. A security mounting according to claim 7 in which said foot member includes a channel spindled on said pair of posts, and an adjustable foot attached to said channel.

* * * * *